United States Patent [19]

Kettlestrings

[11] 3,959,915

[45] June 1, 1976

[54] PROPELLED DISK COPTER TOY

[76] Inventor: John S. Kettlestrings, 434 Carriage Drive 3-B, West Chicago, Ill. 60185

[22] Filed: Jan. 16, 1975

[21] Appl. No.: 541,511

[52] U.S. Cl. ..... 46/74 D; 46/82

[51] Int. Cl.[2] ..... A63H 27/14

[58] Field of Search ..... 46/74 R, 74 D, 82, 84; 273/106 B

[56] References Cited

FOREIGN PATENTS OR APPLICATIONS 467,331 12/1951 Italy ..... 46/74 D

*Primary Examiner*—Louis G. Mancene
*Assistant Examiner*—Robert F. Cutting
*Attorney, Agent, or Firm*—Hill, Gross, Simpson, Van Santen, Steadman, Chiara & Simpson

[57] ABSTRACT

A toy utilizes a resilient elastic impeller to spin and propel a circular disk having aerodynamic characteristics whereby the user can easily control the path of flight of the circular disk in the atmosphere. The impeller is engaged in a slot in the periphery of the disk which secures the impeller as the impeller is flexed by the application of opposing force by the user. When the force is released on the disk, the disk is spun and propelled forward by the deflexing of the impeller.

16 Claims, 10 Drawing Figures

PROPELLED DISK COPTER TOY

BACKGROUND OF THE INVENTION

1. Field of the Invention

This invention relates to devices which are used for amusement and self-entertainment.

2. The Prior Art

The use of an aerodynamic circular disk has been popularized by the "Frisbee". The use in the past has involved a propelling force supplied through a throwing action by the user. What was once a simple toy for throwing has developed as well into an intense sport where teams now compete on a national basis.

SUMMARY OF THE INVENTION

In accordance with this invention a circular disk is formed with its outer periphery surface convexed forming an airfoil. The peripheral edge is slotted to provide for the engagement of a resilient impeller. With the impeller so engaged in the peripheral slot, equal and opposing coupling forces are applied by the user to the unsecured end of the impeller and the periphery of the disk opposite the engaged slot respectively. The impeller is thereby flexed. Upon the release of the coupling force on the disk, the disk is spun and propelled into the atmosphere by the deflexing of the impeller. As the atmosphere passes over the top surface of the disk an aerodynamic lift is created. When forward movement of the disk is slowed by the resistance of the atmosphere, the effect of the gravitational force on the disk is retarded by the entrapment of the atmosphere under the disk.

This invention relates to toys and as such provides recreation and self-entertainment. It is simple and inexpensive. The disk can be formed into the appearance of a number of generic objects such as a tire or a hamburger and thereby be used in commercial promotional programs. This invention is a major improvement over the conventional "Frisbee" in that by providing for use with a resilient impeller, the user need only exercise a minimum amount of skill and dexterity. Many are denied the enjoyment of the play involved with using a conventional "Frisbee" because of the high degree of manual skill and coordination required. By supplying the propelling force through a resilient impeller, the level of skill and coordination required to obtain the desired control over the flight path is significantly reduced. Therefore, even a young child can receive satisfaction from the play with the toy of this invention.

DESCRIPTION OF THE PREFERRED EMBODIMENT

Figure 1:
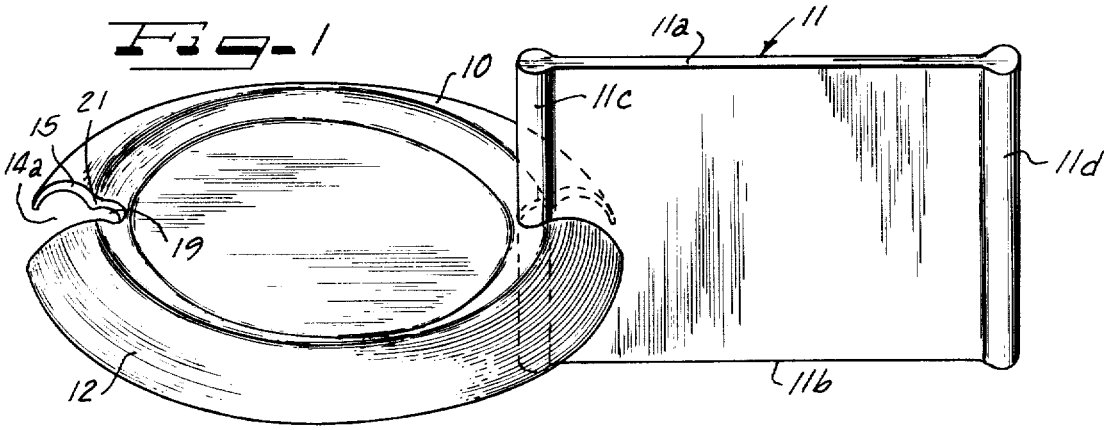
FIG. 1 is a perspective view of the disk and impeller utilizing the principles of the invention.
Figure 2:
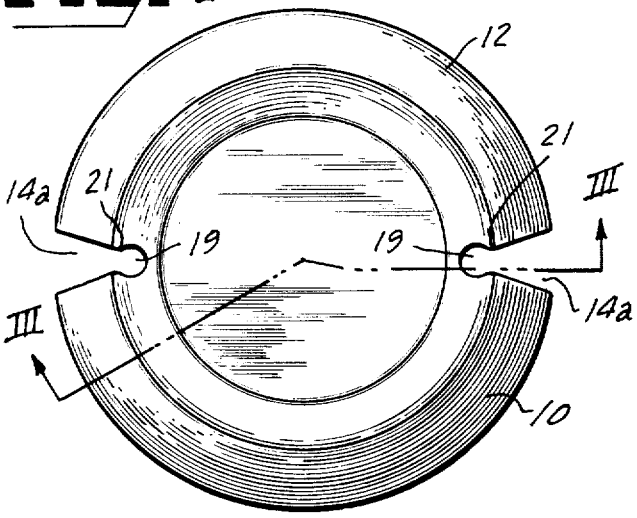
FIG. 2 is a top view of the disk showing one configuration of the engaging slot.

Referring to the drawings, a disk is shown generally at 10 and can be made of any suitable material. The leading edge of the disk 12, and similarly extending around the entire periphery, is convexed shaped forming an airfoil. The disk has a sufficiently thin cross-section so that an entrapping space 13 is formed on the underside of the disk.

The impeller is shown generally at 11 and can be a generally rectangular body member made of any resilient material such as a plastic or metal. For child safety purposes the impeller 11 must be at least 1 by 2¼ inches, and has top and bottom edges 11*a* and 11*b*. The crosssectional thick of the impeller will depend on its length and the modulus of elasticity of the material chosen. The opposite ends of the impeller are beaded as at 11*c* and 11*d*, respectively.

The slot must be sufficiently deep to insure that when the impeller is engaged and flexed by the user applying equal and opposing coupling forces to the unengaged end of the impeller and the periphery of the disk opposite the engaged slot, the impeller remains in position.

The sides of the slot 15 are axially converging so that the dimension of the slot is greater at the periphery than at the base of the slot 16. The function of these angled sides is to allow the disk to freely slide away from the impeller when the disk is released and is spun and propelled forward by the deflexing of the impeller.

Figure 4:
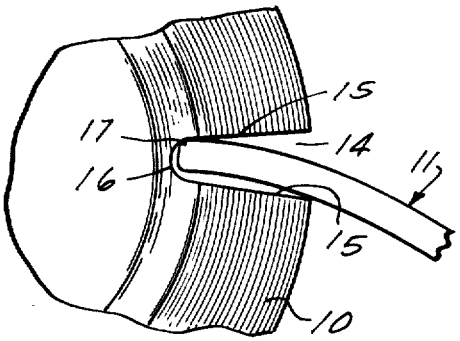
FIG. 4 is a detail showing the relationship of one form of a flexed impeller engaged in one form of slot.
Figure 3:
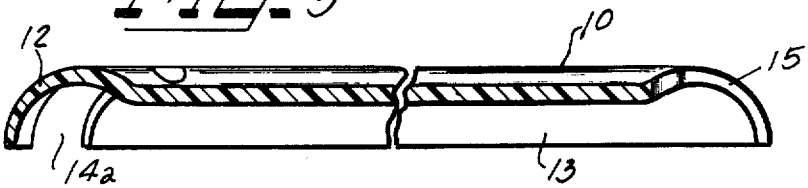
FIG. 3 are cross-sectional views through the disk and through the slotted portion of the disk.

The engaging end of the impeller and the slot configuration can take a number of forms. FIG. 4 shows disk 10 and impeller 11 in which the slot depth to width ratio must exceed 2 and the impeller is uniform in cross-section with the end 17 having radius corners. The ratio of the impeller cross-section to the slot width at the periphery must exceed 2 while the ratio of the cross-section to the slot width at the base of the slot must exceed 1.3. Using this slot and impeller configuration the toy may be operated either right or left handed by the user.

Figure 5:
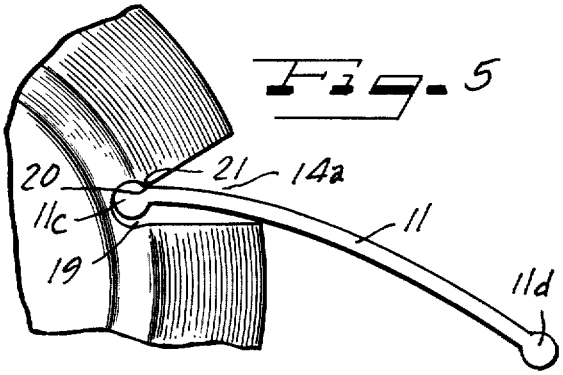
FIG. 5 is a detail showing the relationship of another form of flexed impeller engaged in another form of a slot.

FIG. 5 shows another slot configuration 14*a* in the disk and impeller 11. Each of the beaded portions of the impeller may comprise an enlarged round protrusion 11*c*, 11*d* on the end of the impeller and an enlarged area 19 in the base of the slot the flexed impeller is confined by the interference of the offset 20 on the impeller and the relief 21 in the side edge of the slot. Because of the locking action the depth to width ratio of the slot need not be as great as that shown in FIG. 4. The slot width to impeller cross-section may also be greater to provide more clearance for the impeller when the disk is released and thereby spun and impelled forward by the deflexing impeller. Using this configuration the toy may be operated right or left handed by the user.

Figure 6:
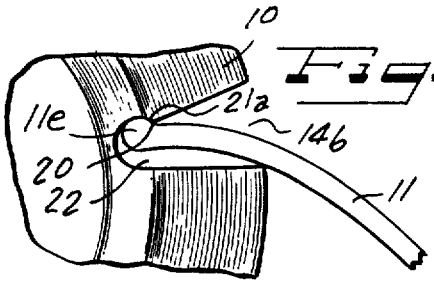
FIG. 6 is a detail showing the relationship of another form of a flexed impeller engaged into yet another form of a slot.

FIG. 6 shows yet another configuration of the slot 14*b* in the disk with impeller 11. In this design the locking action between the slot relief 21*a* and the impeller offset 20 on the partial bead 11*e* is limited to a single hand. Therefore, an opposite hand slot must be provided to make the toy operable by either hand. A maximum amount of clearance 22 between the back of the impeller and the back side of the slot is provided thereby allowing for an increase in coupling force to be applied without an interference between the disk and the impeller upon propelling the disk into flight.

Figure 7:
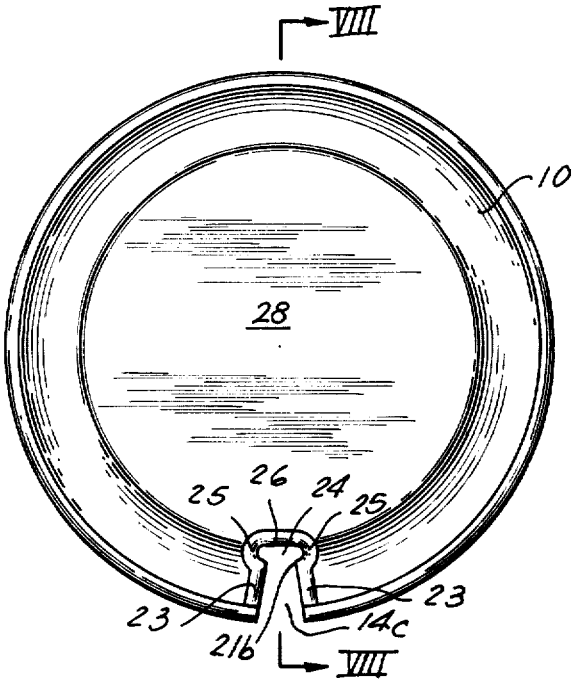
FIG. 7 is a view of the bottom of another form of the disk and notch.
Figure 8:
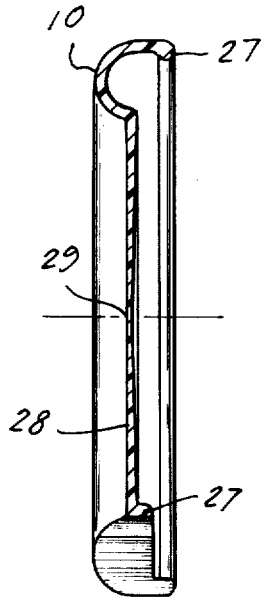
FIG. 8 is a cross-section view through the disk as shown in FIG. 7.

FIG. 7 shows a disk 10 with slot 14*c* having the side walls 23 gradually converging inwardly toward an enlarged area 24 defined by opposing radius sides 25 and a flat bottom 26. The intersection of the converging side walls and the radius side of the enlarged area defines a relief point 21*b*. FIG. 8 shows that this disk has a reinforcing bead 27 on the inside of the leading edge of the disk extending around the circumference. Slot 26 is reinforced by web 27 which follows the outline of the slot. The cross-sectional thickness of the center portion of the disk 28 gradually thins to a minimum at the center of the disk 29. It will be understood that the outer surface of the center portion 28 forms a display surface 28*a* which can be provided with decorative, promotional, or advertising indicia as may be desired.

Figure 9:
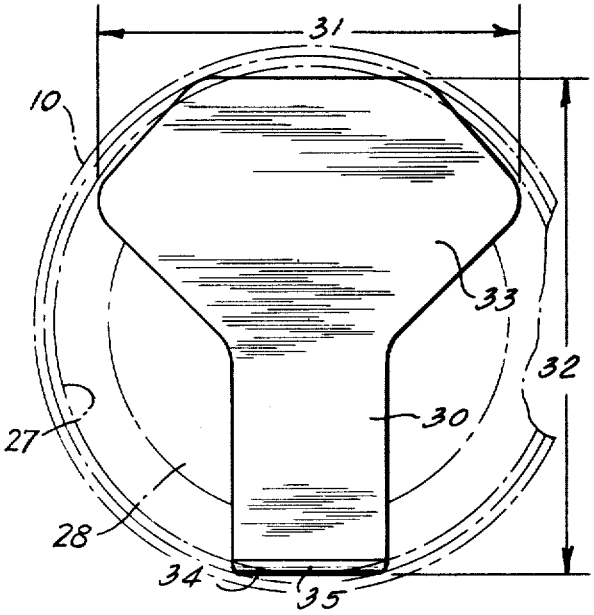
FIG. 9 is the plan view of another form of the impeller. This impeller, as shown, can be inserted into and carried by the disk shown in FIG. 7 and FIG. 8.
Figure 10:
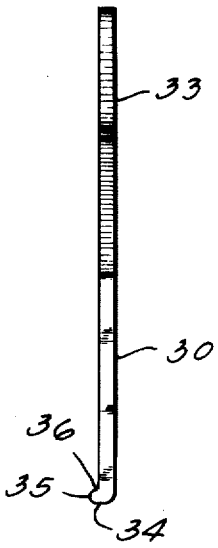
FIG. 10 is the side view of the impeller shown by FIG. 9.

FIG. 9 and FIG. 10 show an impeller 30 having its width dimension 31 and length dimension 32 exceeding the 1 by 2¼ inch requirement noted before. As will be evident from the drawings, the configuration of the impeller 30 provides two pairs of exterior points, the distance between the points of each pair being equidistant and being greater than any other edge to edge dimension. This distance is equal to the inner diameter of the disk as measured adjacent to the bead 27. By correspondingly sizing and shaping the impeller 30, the impeller 30 is conveniently snapped behind the bead 27 and is carried by the disk 10 in a stored position as shown in FIG. 9. The impeller and disk can be conveniently stored as an integral unit when the toy is not being used: The impeller is provided with an enlarged finger gripping area 33 at one of the elongated ends. The opposite end has a studdy right angle flange 34 across the full width of that end. The flange has a rounded bottom edge 35. The interior radius 36 formed by the intersection of the impeller body and the flange is at a minimum to enhance the gripping of the relief point 21*b* when so engaged.

The flight path and the place of landing of the disk can be controlled by the user selectively applying the desired amount of coupling force and controlling the altitude of the disk. By tipping the disk so that the left outer edge is lower than the impeller engaged edge, the disk can be caused to take a course of flight to the left of a line perpendicular to the longitudinal axis of the impeller. Likewise, by tipping the disk so that the left outer edge is higher than the impeller engaged edge, the course of flight can be directed to the right of a line perpendicular to the longitudinal axis of the impeller. If the toy is operated in the opposite hand, the similar performance will be obtained.

Although various modifications might be suggested by those versed in the art, it should be understood that I wish to embody within the scope of the patent warranted hereon all such modifications as reasonably and properly come within the scope of my contribution to the art.

I claim as my invention:

1. A toy comprising:

a. an impeller means having a flat resilient elongated body, said body having a center portion having a substantially rectangular cross-sectional configuration, and end portions being enlarged protrusions respectively, the intersection of said protrusion and said center portion defining an offset, and b. a circular disk having a slot in the periphery thereof to receive the impeller means, wherein said impeller means can be selectively deformed to impel the disk when said impeller is inserted in said disk slot.

2. A toy according to claim 1 and further characterized by:

said slot defined by an inlet in the periphery of said disk, elongated axially disposed and converging sides, and an enlarged base, said respective side and said base intersecting to define an undercut, wherein one end of said impeller is engaged into the slot, said impeller flexed by the application of a coupling force to the opposite unsecured end of said impeller and an equal and opposite coupling force to the disk, and said impeller held secure by the interference of the offset on said impeller with the undercut at the base of the slot and by the interference of the opposite side of the body of the impeller with the opposite elongated side of the slot at the inlet of the slot.

3. A toy comprising:

a. an impeller means for impelling said toy, said impeller means comprising a flat resilient body having a uniform cross section and ends radiused to form a bead, and b. a circular disk having an outer periphery and a slot, said outer periphery having an opening defining an inlet to said slot, said slot further defined by elongated, axially disposed and converging sides and a base, said sides converging toward said base, wherein one end of said impeller is engaged into the slot, said impeller flexed by the application of a coupling force to the opposite unsecured end of said impeller and an equal and opposite coupling force to the disk, and said impeller held secure by the interference of the end of the impeller with the elongated side of the slot at the base and the interference of the opposite side of the body of the impeller with the opposite elongated side of the slot at the inlet of the slot.

4. An aerodymanic toy comprising:

a generally saucer-shaped disk particularly characterized by a generally circular peripheral edge having an interior half round reinforcing bead, said edge notched to provide a propelling slot for an impelling means, said slot being key-shaped and having a radially intermost aperture and diverging walls extending outwardly from said aperture to the peripheral edge, the cross-sectional thickness of the disk center area thinning to a minimum at the center of the disk, said diverging slot side walls being formed by the cross-sectional thickness of the disk body and a downwardly protruding reinforcing web, said innermost circular aperture of said slot defined by opposing radius walls and a flat segment opposite the opening defined by the diverging side walls, and the intersection of a radius side of said aperture and diverging slot wall forming a relief point.

5. A toy according to claim 4 including: an impeller means comprising, a flat elongated resilient body, one end of said body having an enlarged finger gripping area, the opposite end having a flange extending across the width of said body, and one flat surface of said body and adjacent surface of said flange forming at most a right angle and defining a gripping point for engagement with said relief point of said disk.

6. A toy comprising:

a. an impeller means for propelling said toy, said means comprising a resilient elongated member having a substantially rectangular cross-sectional configuration, and b. a circular disk having a slot in the periphery thereof, said slot being defined by elongated and radially disposed sides and a base area and prepared for engagement with an end of an impeller means, wherein one end of said impeller is disposed into the slot, said impeller flexed by the application of a coupling force to the opposite undisposed end of said impeller and an equal and opposite coupling force to the disk, and said impeller held secure by the interference of the disposed end of the impeller with the slot.

7. A toy according to claim 6 and further characterized by said sides of said slot converging toward the base of said slot.

8. A toy according to claim 7 and further characterized by, said base of said slot being enlarged, said converging sides and said base area intersecting to define an undercut, said impeller means having an end formed with an enlarged protrusion, said elongated member and said protrusion intersecting to define an offset, said offset prepared for engagement with said undercut, wherein one end of said impeller is disposed into the slot, said impeller flexed by the application of a coupling force to the opposite undisposed end of said impeller and an equal and opposite coupling force to the disk, and said impeller held secure by the interference of the offset on said impeller with the uncut at the base of the slot and by the interference of the opposite side of the elongated member of the impeller with the opposite elongated side of the slot adjacent to the periphery of the disk.

9. A toy according to claim 6 and further characterized by, said circular disk having a saucer-shaped body.

10. A toy according to claim 6 and further characterized by, said disk having a flat inner circumferent area, said area having an outer surface prepared to receive promotional or decorative indicia.

11. A toy according to claim 9 and further characterized by, said body having an inward protruding bead about the periphery and an inwardly curved wall adjacent to said bead, said wall and said bead prepared to receive and hold said impeller, and said impeller having a maximum overall longitudinal dimension equal to the diameter of said disk as measured at the interface of said bead and said wall, wherein said impeller may be snapped into and carried by said bead and said wall.

12. An aerodynamic toy comprising a generally saucershaped disk characterized by a generally circular peripheral edge notched to provide a propelling slot for an impelling means, said propelling slot generally keyshaped having an intermost radial circular aperture and diverging side walls extending outwardly from said aperture to the periphery edge of the disk, the sides of said aperture and said side walls formed by said disk and a downwardly protruding reinforcing web.

13. A toy according to claim 12 and further characterized by, said circular periphery edge having an inner half round reinforcing bead extending around said edge, said disk having a body, the cross-sectional thickness of said body thinning to a minimum at the center of the disk, said inner radial circular aperture defined by opposing radius walls, a flat segment, and an inlet, said inlet opposite said flat segment and defined by the diverging side walls, said aperture radius side and said diverging wall intersecting to form a relief point.

14. A toy according to claim 12 including:

an impeller means comprising a flat elongated resilient body, one end of said body having an enlarged finger gripping area, the opposite end having a flange extending across the width of said body, and one flat surface of said body and adjacent surface of said flange forming at most a right angle and defining a gripping point for engagement with said relief point of said disk.

15. A toy according to claim 12 and further characterized by, said peripheral edge having an inwardly protruding reinforcing bead, said disk having an inwardly curved wall adjacent to said bead, said wall and said bead prepared to carry the impelling means.

16. A toy according to claim 12 and further characterized by said disk having a flat inner circumferential area, said area having an outer surface prepared to receive promotional or decorative indicia.

* * * * *